US009583066B2

(12) United States Patent
Jiang et al.

(10) Patent No.: US 9,583,066 B2
(45) Date of Patent: Feb. 28, 2017

(54) GATING CONTROL MODULE LOGIC FOR A GATE DRIVING METHOD TO SWITCH BETWEEN INTERLACED AND PROGRESSIVE DRIVING OF THE GATE LINES

(71) Applicants: BOE TECHNOLOGY GROUP CO., LTD., Beijing (CN); Chengdu BOE Optoelectronics Technology Co., Ltd., Chengdu, Sichuan Province (CN)

(72) Inventors: Xue Jiang, Beijing (CN); Xinghua Li, Beijing (CN); Wei He, Beijing (CN)

(73) Assignees: BOE TECHNOLOGY GROUP CO., LTD., Beijing (CN); Chengdu BOE Optoelectronics Technology Co., Ltd., Chengdu, Sichuan Province (CN)

( * ) Notice: Subject to any disclaimer, the term of this patent is extended or adjusted under 35 U.S.C. 154(b) by 41 days.

(21) Appl. No.: 14/552,812

(22) Filed: Nov. 25, 2014

(65) Prior Publication Data

US 2016/0019853 A1 Jan. 21, 2016

(30) Foreign Application Priority Data

Jul. 16, 2014 (CN) ..... 2014 1 0338853

(51) Int. Cl.
*G09G 3/36* (2006.01)

(52) U.S. Cl.
CPC ..... *G09G 3/3681* (2013.01); *G09G 3/3677* (2013.01); *G09G 2310/0213* (2013.01); *G09G 2330/021* (2013.01)

(58) Field of Classification Search
CPC ..... G09G 3/3674; G09G 3/3677; G09G 2310/0267; G09G 2310/0216;
(Continued)

(56) References Cited

U.S. PATENT DOCUMENTS 8,681,142 B2 * 3/2014 Bo-Yong ..... G09G 5/00 345/100
2004/0246388 A1 * 12/2004 Lee ..... G09G 3/3655 349/2

(Continued)

FOREIGN PATENT DOCUMENTS

| | | | |
|---|---|---|---|
| CN | 1758303 | A | 4/2006 |
| JP | 2008020874 | A | 1/2008 |
| KR | 20080084081 | A | 9/2008 |

OTHER PUBLICATIONS

First Chinese Office Action dated Dec. 4, 2016, for corresponding Chinese Application No. 201410338853.6.

*Primary Examiner* — Chanh Nguyen
*Assistant Examiner* — Navin Lingaraju
(74) *Attorney, Agent, or Firm* — Kinney & Lange, P.A.

(57) ABSTRACT

The present disclosure discloses a gate driving method, a driving apparatus of a display panel and a display apparatus. The driving apparatus may be in two driving modes, i.e., a first mode and a second mode. In the first mode, due to a reduced number of gate lines to be driven when various frames of images are displayed, the power consumption can be reduced. In addition, due to the effect of persistence of vision of human eyes, better quality of display images can be ensured while reducing power consumption. In the second mode, as respective lines of gate lines are driven progressively when various frames of images are displayed, the display panel is enabled to have better quality of display images. By switching the driving apparatus between the first mode and second mode, a number of gate lines to be driven can be reduced so as to reduce power consumption.

7 Claims, 4 Drawing Sheets

(58) Field of Classification Search
CPC ... G09G 2310/0224; G09G 2310/0227; G09G 2310/0229; G09G 2310/0283; G09G 2330/02–2330/022; G09G 2310/08; G09G 2310/0213
See application file for complete search history.

(56) References Cited

U.S. PATENT DOCUMENTS

| | | | | |
|---|---|---|---|---|
| 2006/0044251 | A1* | 3/2006 | Kato | G09G 3/3611 345/98 |
| 2006/0071890 | A1* | 4/2006 | Kikuchi | G09G 3/3677 345/87 |
| 2006/0152459 | A1* | 7/2006 | Shin | G09G 3/20 345/94 |
| 2008/0012819 | A1* | 1/2008 | Lee | G09G 3/3677 345/100 |
| 2008/0278467 | A1 | 11/2008 | Hwang et al. | |
| 2010/0110046 | A1 | 5/2010 | Chen et al. | |
| 2010/0277463 | A1* | 11/2010 | Yen | G09G 3/20 345/213 |
| 2012/0044225 | A1* | 2/2012 | Kim | G09G 3/3614 345/209 |
| 2013/0088479 | A1* | 4/2013 | Kim | G09G 3/3614 345/212 |
| 2013/0257925 | A1* | 10/2013 | Kim | H04N 13/0434 345/691 |

* cited by examiner

GATING CONTROL MODULE LOGIC FOR A GATE DRIVING METHOD TO SWITCH BETWEEN INTERLACED AND PROGRESSIVE DRIVING OF THE GATE LINES

TECHNICAL FIELD

The present disclosure relates to a display technology, and more particularly, to a gate driving method, a driving apparatus of a display panel and a display apparatus.

BACKGROUND

Currently, liquid crystal displays have been widely applied in electronic display products, such as televisions, computers, mobile phones and personal digital assistants etc. A liquid crystal display may include a source driver, a gate driver, and a crystal liquid display screen etc. The crystal liquid display screen has an array of pixels, and the gate driver is configured to start corresponding lines of pixels in the array of pixels in order to transmit pixel data output by the source driver to the pixels, thereby displaying images to be displayed.

Conventionally, the gate driver is integrated into the liquid crystal display screen to achieve design of a narrow frame of the liquid crystal display and save cost of an IC. With respect to a small-sized display, a structure of integrating the gate driver on one side is generally used, that is, the gate driver is only integrated on one end of a gate line of a gate substrate. With respect to a large-sized display, as a delay of gate signals due to a large display screen, a long wiring, a high resolution etc. will cause influences such as under-charging of pixels etc., a structure of integrating the gate driver on both sides is generally used, that is, the gate driver is integrated on both ends of a gate line of a gate substrate. However, a driving method of progressive scanning is used in a conventional display regardless of the structure of integrating the gate driver on one side or the structure of integrating the gate driver on both sides. The so-called driving method of progressive scanning is a process of completing display of a frame of images by scanning respective lines of gate lines sequentially from a first gate line within a frame cycle of images.

When the conventional driving method is used for display, power consumption of the display is high. Especially in a trend of increasing resolution and integration level of pixels of the display to improve quality of images, the high power consumption of the display has become an important factor which restricts the development of the display. Therefore, there is a technical problem to be solved of how to reduce the power consumption of the display.

SUMMARY

Embodiments of the present disclosure provide a gate driving method, a driving apparatus of a display panel and a display apparatus, to solve the problem of high power consumption of a display.

Therefore, the embodiments of the present disclosure provide a driving apparatus of a display panel, comprising:

a first gate driver connected to a first trigger signal terminal, configured to drive odd lines of gate lines on the display panel;

a second gate driver connected to a second trigger signal terminal, configured to drive even lines of gate lines on the display panel;

a first gating control module, connected in series between the first trigger signal terminal and the first gate driver; and a second gating control module, connected in series between the second trigger signal terminal and the second gate driver; wherein, the first gating control module and the second gating control module each comprises a mode control signal terminal configured to receive a mode control signal, and the first gating control module and the second gating control module are configured to respectively control the first gate driver and the second gate driver to drive in a first mode when the mode control signal is in a first state; and respectively control the first gate driver and the second gate driver to drive in a second mode when the mode control signal is in a second state; wherein, in the first mode, when odd frames of images are displayed, the odd lines of gate lines are driven sequentially by the first gate driver, and when even frames of images are displayed, the even lines of gate lines are driven sequentially by the second gate driver; or, when the odd frames of images are displayed, the even lines of gate lines are driven sequentially by the second gate driver, and when the even frames of images are displayed, the odd lines of gate lines are driven sequentially by the first gate driver; and in the second mode, when various frames of images are displayed, respective lines of gate lines are driven progressively.

Preferably, the first gating control module further comprises a first gating clock signal terminal configured to receive a first gating clock signal, and the second gating control module further comprises a second gating clock signal terminal configured to receive a second gating clock signal;

when the mode control signal is in the first state, the first gating control module transmits a first trigger signal transmitted by the first trigger signal terminal to the first gate driver to drive the odd lines of gate lines sequentially when the first gating clock signal is a valid signal, and the second gating control module transmits a second trigger signal transmitted by the second trigger signal terminal to the second gate driver to drive the even lines of gate lines sequentially when the second gating clock signal is a valid signal;

when the mode control signal is in the second state, the first gating control module transmits the first trigger signal to the first gate driver to drive the odd lines of gate lines sequentially; and the second gating control module transmits the second trigger signal to the second gate driver to drive the even lines of gate lines sequentially; and the first gating clock signal and the second gating clock signal have opposite phases and the same period which is a sum of display two frame cycles of images.

In an alternative implementation, the first gating control module may comprise a first Negated AND (NAND) gate, a second NAND gate, a first NOT gate and a second NOT gate, wherein, the first NOT gate has an input terminal which is the first gating clock signal terminal of the first gating control module, and an output terminal connected to a first input terminal of the first NAND gate;

the first NAND gate has a second input terminal which is the mode control signal terminal of the first gating control module and an output terminal connected to a first input terminal of the second NAND gate;

the second NAND gate has a second input terminal connected to the first trigger signal terminal and an output terminal connected to an input terminal of the second NOT gate; and the second NOT gate has an output terminal connected to the first gate driver.

In another alternative implementation, the first gating control module may comprise a first transistor, a second transistor, and a third transistor, wherein, the first transistor and the second transistor each has a gate which is the mode control signal terminal of the first gating control module and a source connected to the first trigger signal terminal, the first transistor has a drain connected to a source of the third transistor, and the second transistor has a drain respectively connected to the first gate driver and a drain of the third transistor;

the third transistor has a gate which is the first gating clock signal terminal of the first gating control module; and the first transistor is an N-type transistor, and the second transistor is a P-type transistor; or the first transistor is a P-type transistor, and the second transistor is an N-type transistor.

In an alternative implementation, the second gating control module may comprise a third NAND gate, a fourth NAND gate, a third NOT gate and a fourth NOT gate, wherein, the third NOT gate has an input terminal which is the second gating clock signal terminal of the second gating control module, and an output terminal connected to a first input terminal of the third NAND gate;

the third NAND gate has a second input terminal which is the mode control signal terminal of the second gating control module, and an output terminal connected to a first input terminal of the fourth NAND gate;

the fourth NAND gate has a second input terminal connected to the second trigger signal terminal and an output terminal connected to an input terminal of the fourth NOT gate; and the fourth NOT gate has an output terminal connected to the second gate driver.

In an alternative implementation, the second gating control module may comprise a fourth transistor, a fifth transistor, and a sixth transistor, wherein, the fourth transistor and the fifth transistor each has a gate which is the mode control signal terminal of the second gating control module and a source connected to the second trigger signal terminal, the fourth transistor has a drain connected to a source of the sixth transistor, and the fifth transistor has a drain respectively connected to the second gate driver and a drain of the sixth transistor;

the sixth transistor has a gate which is the second gating clock signal terminal of the second gating control module; and the fourth transistor is an N-type transistor, and the fifth transistor is a P-type transistor; or the fourth transistor is a P-type transistor, and the fifth transistor is an N-type transistor.

Preferably, both the third transistor and the sixth transistor are N-type transistors or P-type transistors.

Correspondingly, the embodiments of the present disclosure further provide a display apparatus, comprising any of the above driving apparatuses according to an embodiment of the present disclosure.

The embodiments of the present disclosure further provide a gate driving method of a display panel, the display panel comprising multiple gate lines, a first gate driver connected to a first trigger signal terminal and configured to drive odd lines of gate lines on the display panel, a second gate driver connected to a second trigger signal terminal and configured to drive even lines of gate lines on the display panel, and a mode control signal terminal configured to transmit a mode control signal, the driving method comprising:

controlling a driving manner of the first gate driver and the second gate driver to be a first mode when the mode control signal is in a first state, and controlling the driving manner of the first gate driver and the second gate driver to switch from the current first mode to a second mode when the mode control signal changes to being in a second state from being in the first state; and controlling the driving manner of the first gate driver and the second gate driver to be the second mode when the mode control signal is in the second state, and controlling the driving manner of the first gate driver and the second gate driver to switch from the current second mode to the first mode when the mode control signal changes to being in the first state from being in the second state; wherein, in the first mode, when odd frames of images are displayed, the odd lines of gate lines are driven sequentially, and when even frames of images are displayed, the even lines of gate lines are driven sequentially; or, when the odd frames of images are displayed, the even lines of gate lines are driven sequentially, and when the even frames of images are displayed, the odd lines of gate lines are driven sequentially; and in the second mode, when various frames of images are displayed, respective lines of gate lines are driven progressively.

The above gate driving method and driving apparatus of a display panel and a display apparatus according to an embodiment of the present disclosure may be in two driving modes, i.e., a first mode and a second mode. When the gate lines are driven in the first mode, due to a reduced number of gate lines to be driven when various frames of images are displayed, the power consumption can be reduced. In addition, due to the effect of persistence of vision of human eyes, better quality of display images can be ensured while reducing power consumption. When the gate lines are driven in the second mode, as respective lines of gate lines are driven progressively when various frames of images are displayed, the display panel is enabled to have better quality of display images. By switching the driving apparatus according to an embodiment of the present disclosure between the first mode and second mode, the number of gate lines to be driven can be reduced so as to reduce power consumption.

DETAILED DESCRIPTION OF THE EMBODIMENTS

Specific implementations of a gate driving method and driving apparatus of a display panel and a display apparatus according to an embodiment of the present disclosure will be described in detail below in combination with accompanying drawings.

Figure 1:
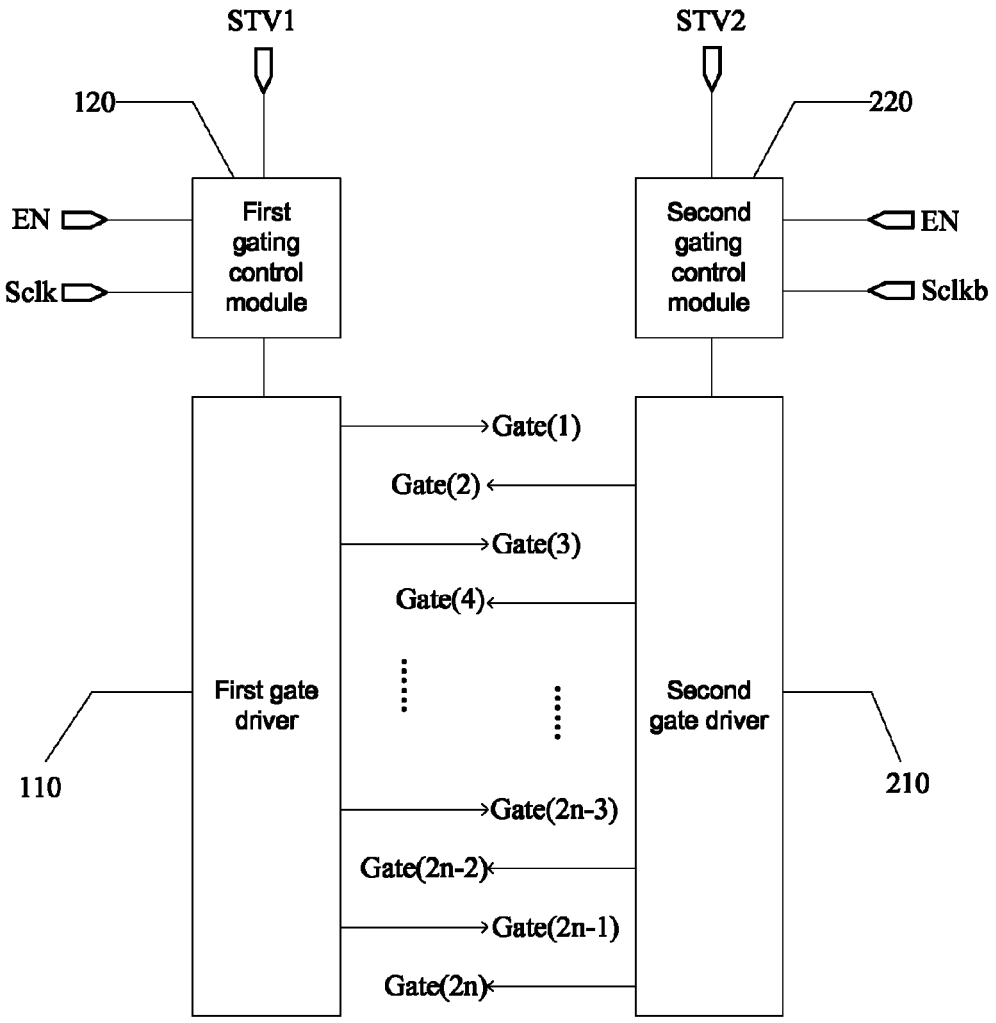
FIG. 1 illustrates a structural diagram of a driving apparatus according to an embodiment of the present disclosure.

As shown in FIG. 1, in an embodiment of the present disclosure, a driving apparatus of a display panel is provided, including a first gate driver 110 connected to a first trigger signal terminal, configured to drive odd lines of gate lines Gate(2*n*−1) on the display panel; a second gate driver 210 connected to a second trigger signal terminal, configured to drive even lines of gate lines Gate(2*n*) on the display panel, where n is a positive integer larger than or equal to 1; a first gating control module 120, connected in series between the first trigger signal terminal and the first gate driver 110; and a second gating control module 220, connected in series between the second trigger signal terminal and the second gate driver 210.

The first gating control module 120 and the second gating control module 220 each includes a mode control signal terminal configured to receive a mode control signal EN. The first gating control module 120 and the second gating control module 220 are configured to respectively control the first gate driver 110 and the second gate driver 210 to drive in a first mode when the mode control signal EN indicates a first state; and respectively control the first gate driver 110 and the second gate driver 210 to drive in a second mode when the mode control signal EN indicates a second state. In the first mode, when odd frames of images are displayed, the odd lines of gate lines Gate(2*n*−1) are driven sequentially, and when even frames of images are displayed, the even lines of gate lines Gate(2*n*) are driven sequentially. Alternatively, when the odd frames of images are displayed, the even lines of gate lines Gate(2*n*) are driven sequentially, and when the even frames of images are displayed, the odd lines of gate lines Gate(2*n*−1) are driven sequentially. In the second mode, when various frames of images are displayed, respective lines of gate lines Gate(n) are driven progressively.

It should be noted that in the above driving apparatus according to an embodiment of the present disclosure, the first state and the second state may indicate that the mode control signals are a high level signal and a low level signal respectively; or the first state and the second state may indicate that the mode control signals are a low level signal and a high level signal respectively. The present disclosure is not limited thereto.

Preferably, as shown in FIG. 1, the first gating control module 120 further includes a first gating clock signal terminal configured to receive a first gating clock signal Sclk, and the second gating control module 220 further includes a second gating clock signal terminal configured to receive a second gating clock signal Sclkb. When the mode control signal EN is in the first state, the first gating control module 120 transmits a first trigger signal STV1 transmitted by the first trigger signal terminal to the first gate driver 110 to drive the odd lines of gate lines Gate(2*n*−1) sequentially when the first gating clock signal Sclk is a valid signal, and the second gating control module 220 transmits a second trigger signal STV2 transmitted by the second trigger signal STV2 terminal to the second gate driver 210 to drive the even lines of gate lines Gate(2*n*) sequentially when the second gating clock signal Sclkb is a valid signal. When the mode control signal EN is in the second state, the first gating control module 120 transmits the first trigger signal STV1 to the first gate driver 110 to drive the odd lines of gate lines Gate(2*n*−1) sequentially, and the second gating control module 220 transmits the second trigger signal STV2 to the second gate driver 210 to drive the even lines of gate lines Gate(2*n*) sequentially. The first gating clock signal Sclk and the second gating clock signal Sclkb have opposite phases and the same period which is a sum of display two frame cycles of images.

The present disclosure will be described in detail below. It should be noted that the present embodiment is merely used to better explain the present disclosure instead of limiting the present disclosure.

Figure 2A:
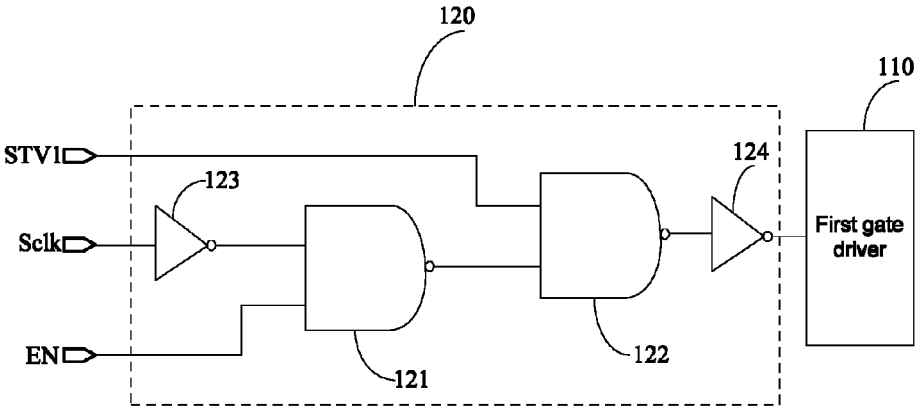
FIG. 2A illustrates a structural diagram of a first example of a first gating control module according to an embodiment of the present disclosure.

Preferably, as shown in FIG. 2A, in the driving apparatus according to an embodiment of the present disclosure, the first gating control module 120 may include a first NAND gate 121, a second NAND gate 122, a first NOT gate 123 and a second NOT gate 124. The first NOT gate 123 has an input terminal which is the first gating clock signal Sclk terminal of the first gating control module 120, and an output terminal connected to a first input terminal of the first NAND gate 121. The first NAND gate 121 has a second input terminal which is the mode control signal EN terminal of the first gating control module 120 and an output terminal connected to a first input terminal of the second NAND gate 122. The second NAND gate 122 has a second input terminal connected to the first trigger signal STV1 terminal and an output terminal connected to an input terminal of the second NOT gate 124. The second NOT gate 124 has an output terminal connected to the first gate driver 110.

Specifically, in the above driving apparatus according to an embodiment of the present disclosure, in the case that a structure of the first gating control module 120 is the above structure illustrated in FIG. 2A, when the mode control signal EN is a high level signal, the mode control signal EN is in a first state, and when the mode control signal EN is a low level signal, the mode control signal EN is in a second state. At the same time, when the first gating clock signal Sclk is a high level signal, the first gating clock signal Sclk is a valid signal.

Specifically, when the first gating control module 120 in the above driving apparatus according to an embodiment of the present disclosure uses a specific structure including a first NAND gate, a second NAND gate, a first NOT gate, and a second NOT gate, an operating principle thereof is as described below. When the mode control signal EN is a high level signal, an output terminal of the first NAND gate outputs a high level signal when the first gating clock signal Sclk is a high level signal, and at this time, the first trigger signal STV1 is transmitted to the first gate driver 110 to drive the odd lines of gate lines sequentially; and the output terminal of the first NAND gate outputs a low level signal when the first gating clock signal Sclk is a low level signal. At this time, the first trigger signal STV1 is not output. When the mode control signal EN is a low level signal, the first gating clock signal Sclk is shielded and cannot be output. Therefore, the output terminal of the first NAND gate outputs a high level signal no matter whether the first gating clock signal Sclk is a low level signal or a high level signal, and at this time, the first trigger signal STV1 is transmitted to the first gate driver 110 to drive the odd lines of gate lines sequentially.

Figure 3A:
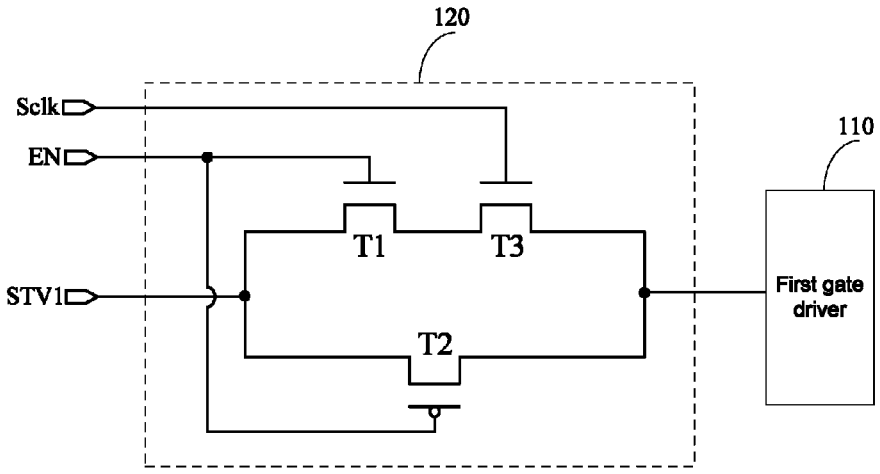
FIG. 3A illustrates a structural diagram of a second example of a first gating control module according to an embodiment of the present disclosure.

Alternatively, in the driving apparatus according to an embodiment of the present disclosure, as shown in FIG. 3A, the first gating control module 120 may include a first transistor T1, a second transistor T2, and a third transistor T3. The first transistor T1 and the second transistor T2 each has a gate which is the mode control signal EN terminal of the first gating control module 120 and a source connected to the first trigger signal STV1 terminal. The first transistor T1 has a drain connected to a source of the third transistor T3, and the second transistor T2 has a drain respectively connected to the first gate driver 110 and a drain of the third transistor T3. The third transistor T3 has a gate which is the first gating clock signal Sclk terminal of the first gating control module 120. The first transistor T1 is an N-type transistor, and the second transistor is a P-type transistor; or the first transistor T1 is a P-type transistor, and the second transistor T2 is an N-type transistor.

Specifically, in the above driving apparatus according to an embodiment of the present disclosure, when a structure of the first gating control module 120 is the above structure illustrated in FIG. 3A, in the case that the first transistor is a P-type transistor, when the mode control signal EN is a low level signal, the mode control signal EN is in a first state, and when the mode control signal EN is a high level signal, the mode control signal EN is in a second state. In contrary, in the case that the first transistor is an N-type transistor, when the mode control signal EN is a high level signal, the mode control signal EN is in a first state, and when the mode control signal EN is a low level signal, the mode control signal EN is in a second state. In the case that the third transistor is a P-type transistor, the first gating clock signal Sclk is a low level signal, the first gating clock signal Sclk is a valid signal. In contrary, when the third transistor is an N-type transistor, in the case that the first gating clock signal Sclk is a high level signal, the first gating clock signal Sclk is a valid signal.

Specifically, when the first gating control module 120 in the driving apparatus according to an embodiment of the present disclosure uses the above specific structure including a first transistor, a second transistor and a third transistor, the operating principle thereof will be described below by taking N-type transistors as the first transistor and the third transistor and a P-type transistor as the second transistor. When the mode control signal EN is a high level signal, the second transistor is turned off, the first transistor is turned on, and only if the first gating clock signal Sclk is a high level signal, the third transistor is turned on, so as to transmit the first trigger signal STV1 to the first gate driver 110 to drive the odd lines of gate lines sequentially. When the first gating clock signal Sclk is a low level signal, the first trigger signal STV1 is not transmitted to the first gate driver 110. When the mode control signal EN is a low level signal, the first transistor is turned off, the second transistor is turned on, and no matter whether the third transistor is turned on, the first trigger signal terminal is connected to the first gate driver, so as to transmit the first trigger signal STV1 to the first gate driver to drive the odd lines of gate lines sequentially.

The specific structure of the first gating control module in the driving apparatus is merely described above by way of example. In a specific implementation, the specific structure of the first gating control module is not limited to the above structure according to an embodiment of the present disclosure, and may be other structure known by those skilled in the art, which will not be limited here.

Figure 2B:
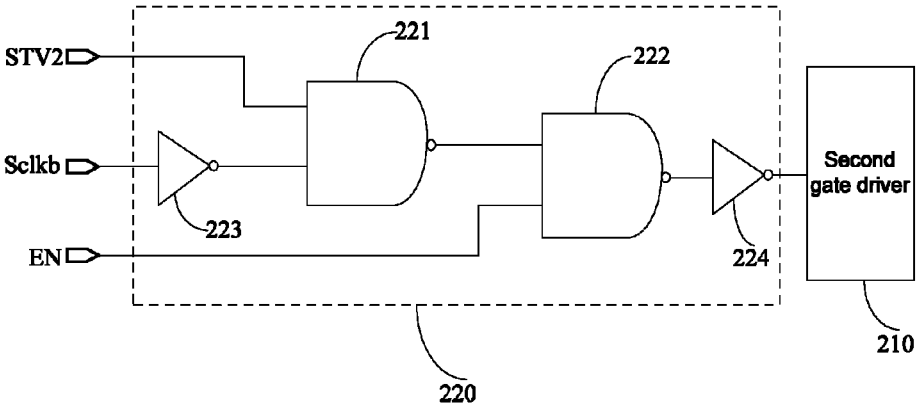
FIG. 2B illustrates a structural diagram of a first example of a second gating control module according to an embodiment of the present disclosure.

Preferably, as shown in FIG. 2B, in the driving apparatus according to an embodiment of the present disclosure, the second gating control module 220 may include a third NAND gate 221, a fourth NAND gate 222, a third NOT gate 223 and a fourth NOT gate 224. The third NOT gate 223 has an input terminal which is the second gating clock signal terminal of the second gating control module 220, and an output terminal connected to a first input terminal of the third NAND gate 221. The third NAND gate 221 has a second input terminal which is the mode control signal terminal of the second gating control module 220, and an output terminal connected to a first input terminal of the fourth NAND gate 222. The fourth NAND gate 222 has a second input terminal connected to the second trigger signal terminal and an output terminal connected to an input terminal of the fourth NOT gate 224; and the fourth NOT gate 224 has an output terminal connected to the second gate driver 210.

Specifically, in the above driving apparatus according to an embodiment of the present disclosure, in the case that a structure of the second gating control module is the above structure illustrated in FIG. 2B, when the mode control signal EN is a high level signal, the mode control signal EN is in a first state, and when the mode control signal EN is a low level signal, the mode control signal EN is in a second state. At the same time, when the first gating clock signal Sclk is a high level signal, the first gating clock signal Sclk is a valid signal.

Specifically, when the second gating control module in the above driving apparatus according to an embodiment of the present disclosure uses a specific structure including a third NAND gate, a fourth NAND gate, a third NOT gate, and a fourth NOT gate, an operating principle thereof is as described below. When the mode control signal EN is a high level signal, an output terminal of the third NAND gate outputs a high level signal when the second gating clock signal Sclkb is a high level signal, and at this time, the second trigger signal STV2 is transmitted to the second gate driver to drive the even lines of gate lines sequentially. The output terminal of the third NAND gate outputs a low level signal when the second gating clock signal Sclkb is a low level signal, and at this time, the second trigger signal STV2 is shielded and cannot be output. When the mode control signal EN is a low level signal, the second gating clock signal Sclkb is shielded and cannot be output. Therefore, the output terminal of the third NAND gate outputs a high level signal no matter whether the second gating clock signal Sclkb is a low level signal or a high level signal, and at this time, the second trigger signal STV2 is transmitted to the second gate driver 210 to drive the even lines of gate lines sequentially.

Figure 3B:
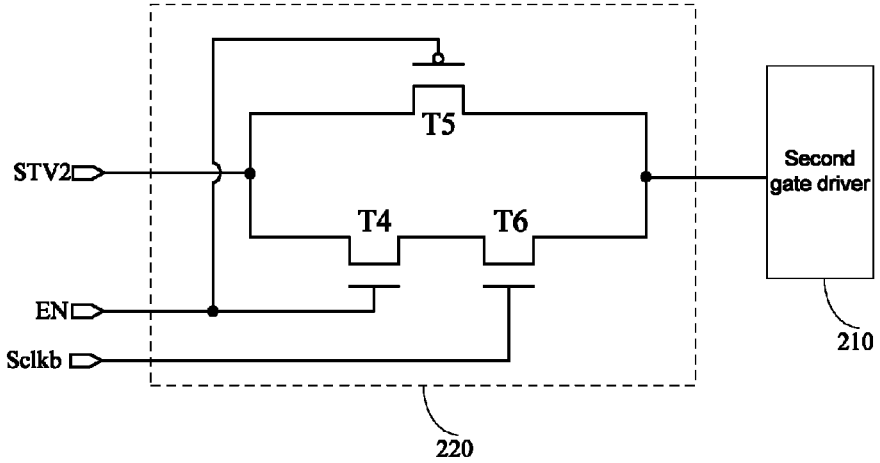
FIG. 3B illustrates a structural diagram of a second example of a second gating control module according to an embodiment of the present disclosure.

Alternatively, in the driving apparatus according to an embodiment of the present disclosure, as shown in FIG. 3B, the second gating control module 220 may include a fourth transistor T4, a fifth transistor T5, and a sixth transistor T6. The fourth transistor T4 and the fifth transistor T5 each has a gate which is the mode control signal terminal of the second gating control module 220 and a source connected to the second trigger signal terminal. The fourth transistor T4 has a drain connected to a source of the sixth transistor T6, and the fifth transistor T5 has a drain respectively connected to the second gate driver 210 and a drain of the sixth transistor T6. The sixth transistor T6 has a gate which is the second gating clock signal terminal of the second gating control module 220. The fourth transistor T4 is an N-type transistor, and the fifth transistor T5 is a P-type transistor; or the fourth transistor T4 is a P-type transistor, and the fifth transistor T5 is an N-type transistor.

Specifically, in the above driving apparatus according to an embodiment of the present disclosure, when a structure of the second gating control module is the above structure illustrated in FIG. 3B, in the case that the fourth transistor is a P-type transistor, when the mode control signal EN is a low level signal, the mode control signal EN is in a first state, and when the mode control signal EN is a high level signal, the mode control signal EN is in a second state. In contrary, in the case that the fourth transistor is an N-type transistor, when the mode control signal EN is a high level signal, the mode control signal EN is in a first state, and when the mode control signal EN is a low level signal, the mode control signal EN is in a second state. In the case that the sixth transistor is a P-type transistor, when the second gating clock signal Sclkb is a low level signal, the second gating clock signal Sclkb is a valid signal. In contrary, in the case that the sixth transistor is an N-type transistor, when the second gating clock signal Sclkb is a high level signal, the second gating clock signal Sclkb is a valid signal.

Specifically, when the second gating control module in the above driving apparatus according to an embodiment of the present disclosure uses the above specific structure including a fourth transistor, a fifth transistor and a sixth transistor, an operating principle thereof will be described below by taking N-type transistors as the fourth transistor and the fifth transistor and a P-type transistor as the sixth transistor. When the mode control signal EN is a high level signal, the fifth transistor is turned off, the fourth transistor is turned on, and only if the second gating clock signal Sclkb is a high level signal, the sixth transistor is turned on, and thus the second trigger signal terminal is connected to the second gate driver, so as to transmit the second trigger signal to the second gate driver to drive the even lines of gate lines sequentially. When the second gating clock signal Sclkb is a low level signal, the second trigger signal terminal is disconnected from the second gate driver. When the mode control signal EN is a low level signal, the fourth transistor is turned off, the fifth transistor is turned on, and no matter whether the sixth transistor is turned on, the second trigger signal terminal is connected to the second gate driver, so as to transmit the second trigger signal STV2 to the second gate driver to drive the even lines of gate lines sequentially.

The specific structure of the second gating control module in the driving apparatus is merely described above by way of example. In a specific implementation, the specific structure of the second gating control module is not limited to the above structure according to an embodiment of the present disclosure, and may be other structure known by those skilled in the art, which will not be limited here.

Preferably, when the first gating control module and the second gating control module use the structures illustrated in FIGS. 3*a* and 3*b* respectively, both the third transistor and the sixth transistor are N-type transistors or P-type transistors.

In a specific implementation, the first gating control module and the second gating control module may be integrated in a driver IC of a display panel by a manufacturing process of the driver IC. Preferably, the first gating control module and the second gating control module may be formed on an array substrate of the display panel by an array process. Such integration process not only saves cost, but also achieves an aesthetic design of the display panel which is symmetric on both sides. At the same time, a bonding area and a wiring space for fan-out can further be omitted, thereby achieving a design of a narrow frame.

Figure 4:
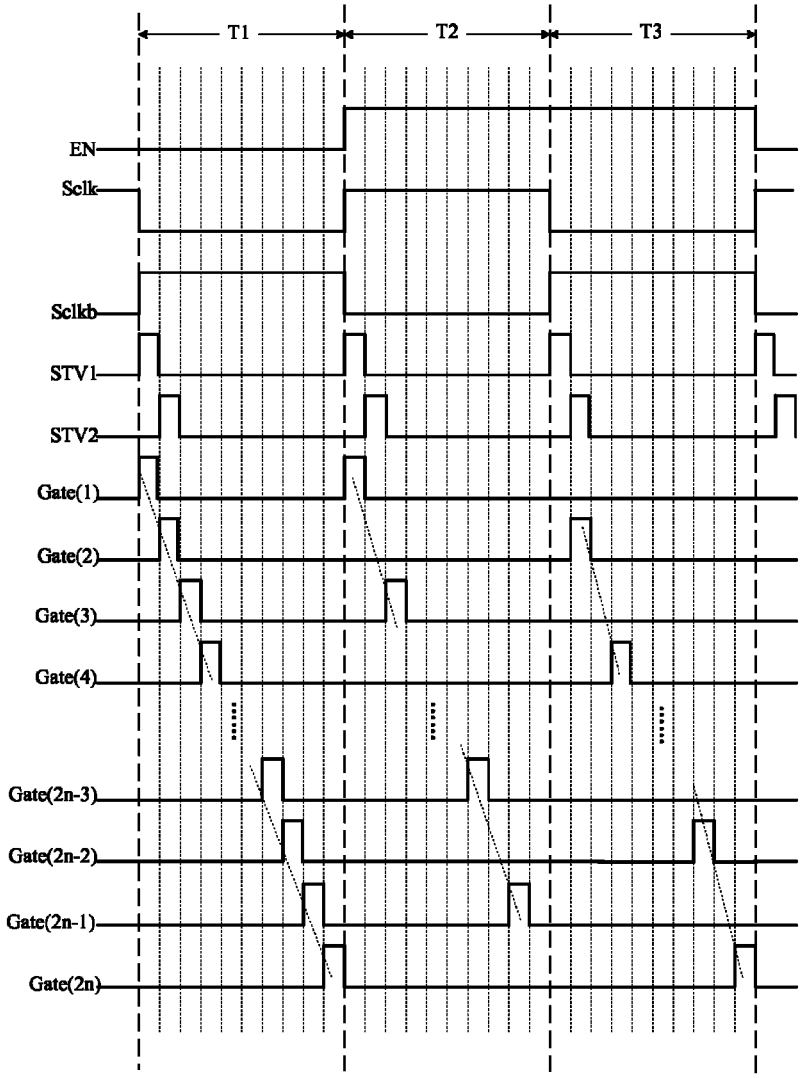
FIG. 4 illustrates a timing diagram of a circuit of a driving apparatus according to an embodiment of the present disclosure.

An operation process of a driving apparatus according to an embodiment of the present disclosure will be described below in combination with the driving apparatuses illustrated in FIGS. 2*a* and 2*b* and FIGS. 3*a* and 3*b* by taking an input-output timing diagram illustrated in FIG. 4. In FIG. 4, EN represents a mode control signal, Sclk represents a first gating clock signal, Sclkb represents a second gating clock signal, STV1 represents a first trigger signal, STV2 represents a second trigger signal, and Gate(n) represents signals of a $n^{th}$ line of gate lines. In the following description, 1 represents a high level signal, and 0 represents a low level signal.

First Example

The operation process of a driving apparatus will be described by taking the driving apparatus of the structure illustrated FIGS. 2*a* and 2*b* as an example. Specifically, three stages T1, T2, and T3 in the input-output timing diagram illustrated in FIG. 4 are selected.

In stage T1, EN=0. In this stage, as EN=0, the first gating clock signal Sclk is shielded and cannot be output, and therefore, no matter whether Sclk=0 or Sclk=1, as long as a first trigger signal STV1 is output, the first trigger signal STV1 will be transmitted to the first gate driver to drive odd lines of gate lines sequentially. In this stage, as EN=0, the second gating clock signal Sclkb is shielded and cannot be output. Therefore, no matter whether Sclkb=0 or Sclkb=1, as long as a second trigger signal STV2 is output, the second trigger signal STV2 will be transmitted to the second gate driver to drive even lines of gate lines sequentially. Within display a frame cycle of images, the first gate driver cooperates with the second gate driver to enable driving various lines of gate lines progressively.

In stage T2, EN=1, Sclk=1 and Sclkb=0. In this stage, as EN=1 and Sclk=1, when the output terminal of the first NAND gate outputs 1, as long as a first trigger signal STV1 is output, the first trigger signal STV1 will be transmitted to the first gate driver to drive odd lines of gate lines sequentially. In this stage, as EN=1 and Sclkb=0, the output terminal of the third NAND gate outputs 0, and at this time, the second trigger signal STV2 is shielded and cannot be output. Therefore, within display of a frame cycle of images, only the first gate driver drives odd lines of gate lines sequentially.

In stage T3, EN=1, Sclk=0 and Sclkb=1. In this stage, as EN=1 and Sclkb=1, when the output terminal of the third NAND gate outputs 1, as long as a second trigger signal STV2 is output, the second trigger signal STV2 will be transmitted to the second gate driver to drive even lines of gate lines sequentially. In this stage, as EN=1 and Sclk=0, the output terminal of the first NAND gate outputs 0, and at this time, the first trigger signal STV1 is shielded and cannot be output. Therefore, within display time of a frame cycle, only the second gate driver drives even lines of gate lines sequentially.

In stage T1, when various frames of images are displayed, respective lines of gate lines are driven progressively, and therefore the display panel is enabled to have better quality of display images. In stages T2 and T3, due to a reduced number of gate lines to be driven when various frames of images are displayed, the power consumption can be reduced. In addition, due to the effect of persistence of vision of human eyes, better quality of display images can be ensured while reducing power consumption. Therefore, by switching the driving apparatus between the first mode and second mode, a number of gate lines to be driven can be reduced to reduce power consumption.

Second Example

The operation process of a driving apparatus will be described by taking the driving apparatus of the structure illustrated FIGS. 3*a* and 3*b* as an example. The description is made by taking N-type transistors as the first transistor, the third transistor, the fourth transistor, and the sixth transistor and P-type transistors as the second transistor and the fifth transistor as an example. Specifically, three stages T1, T2, and T3 in the input-output timing diagram illustrated in FIG. 4 are selected.

In stage T1, EN=0. In this stage, as EN=0, the first transistor is turned off, the second transistor is turned on, no matter whether the third transistor is turned on (i.e., no matter whether Sclk=0 or Sclk=1), both the first trigger signal terminal and the first gate driver are turned on, and therefore, as long as a first trigger signal STV1 is output, the first trigger signal STV1 will be transmitted to the first gate driver to drive odd lines of gate lines sequentially. In this stage, as EN=0, the fourth transistor is turned off, the fifth transistor is turned on, no matter whether the sixth transistor is turned on (i.e., no matter whether Sclkb=0 or Sclkb=1), both the second trigger signal terminal and the second gate driver are turned on. As long as a second trigger signal STV2 is output, the second trigger signal STV2 will be transmitted to the second gate driver to drive even lines of gate lines sequentially. Within display time of a frame cycle, the first gate driver cooperates with the second gate driver to enable driving various lines of gate lines progressively.

In stage T2, EN=1, Sclk=1 and Sclkb=0. In this stage, as EN=1 and Sclk=1, the second transistor is turned off, the first transistor and the third transistor are turned on, the first trigger signal terminal is connected to the first gate driver. As long as a first trigger signal STV1 is output, the first trigger signal STV1 will be transmitted to the first gate driver to drive odd lines of gate lines sequentially. In this stage, as EN=1 and Sclkb=0, the fourth transistor is turned on, the fifth transistor and the sixth transistor are turned off, and at this time, the second trigger signal STV2 terminal and the second gate driver are in a turn-off state. Therefore, within display time of a frame cycle, only the first gate driver drives odd lines of gate lines sequentially.

In stage T3, EN=1, Sclk=0 and Sclkb=1. In this stage, as EN=1 and Sclkb=1, the fifth transistor is turned off, the fourth transistor and the sixth transistor are turned on, the second trigger signal terminal is connected to the second gate driver. As long as a second trigger signal STV2 is output, the second trigger signal STV2 will be transmitted to the second gate driver to drive even lines of gate lines sequentially. In this stage, as EN=1 and Sclk=0, the first transistor is turned on, the second transistor and the third transistor are turned off, and at this time, the first trigger signal STV1 terminal is disconnected from the first gate driver. Therefore, within display time of a frame cycle, only the second gate driver drives even lines of gate lines sequentially.

In addition, the first gate driver and the second gate driver each is a conventional gate driver and a specific structure thereof will be omitted here.

Embodiments of the present disclosure further provide a display apparatus, including any of the above driving apparatuses according to an embodiment of the present disclosure. The display apparatus may include any product or part with a display function such as a mobile phone, a tablet, a television, a display, a notebook, a digital photo frame, a navigator etc. Specifically, the display apparatus may be implemented with reference to the above embodiments of the driving apparatus. Repeated parts will be omitted here.

The embodiments of the present disclosure further provide a gate driving method of a display panel, the display panel comprising multiple gate lines, a first gate driver connected to a first trigger signal terminal and configured to drive odd lines of gate lines on the display panel, a second gate driver connected to a second trigger signal terminal and configured to drive even lines of gate lines on the display panel, and a mode control signal terminal configured to transmit a mode control signal, the driving method comprising:

controlling a driving manner of the first gate driver and the second gate driver to be a first mode when the mode control signal is in a first state, and controlling the driving manner of the first gate driver and the second gate driver to switch from the current first mode to a second mode when the mode control signal changes to being in a second state from being in the first state; and controlling the driving manner of the first gate driver and the second gate driver to be the second mode when the mode control signal is in the second state, and controlling the driving manner of the first gate driver and the second gate driver to switch from the current second mode to the first mode when the mode control signal changes to being in the first state from being in the second state; wherein, in the first mode, when odd frames of images are displayed, the odd lines of gate lines are driven sequentially, and when even frames of images are displayed, the even lines of gate lines are driven sequentially; or, when the odd frames of images are displayed, the even lines of gate lines are driven sequentially, and when the even frames of images are displayed, the odd lines of gate lines are driven sequentially; and in the second mode, when various frames of images are displayed, respective lines of gate lines are driven progressively.

It should be noted that in the embodiments of the present disclosure, even lines of gate lines and odd lines of gate lines on the display panel are scanned respectively as two independent units in different time, so as to reduce a number of gate lines to be driven during display. Other solutions should belong to the protection scope of the present disclosure If these solutions use the same technical principle as the present solution, i.e., the substantive innovation or improvement is achieved by merely changing to a different combination of units of gate lines from that in the present solution, for example, upper gate lines on the display panel which are used as one independent unit and lower gate lines on the display panel which are used as the other independent unit, are scanned in different time, or even more independent units of gate lines are combined to be scanned in different time.

Obviously, various modifications and variants can be made to the present disclosure by those skilled in the art without departing from the spirit and scope of the present disclosure. Therefore, these modifications and variants are to be encompassed by the present disclosure if they fall within the scope of the present disclosure as defined by the claims and their equivalents.

What is claimed is:

1. A driving apparatus of a display panel, comprising:

a first gate driver connected to a first trigger signal terminal, configured to drive odd lines of gate lines on the display panel;

a second gate driver connected to a second trigger signal terminal, configured to drive even lines of gate lines on the display panel;

a first gating control module, connected in series between the first trigger signal terminal and the first gate driver; and a second gating control module, connected in series between the second trigger signal terminal and the second gate driver;

wherein the first gating control module and the second gating control module each comprises a mode control signal terminal configured to receive a mode control signal;

wherein the first gating control module and the second gating control module are configured to respectively control the first gate driver and the second gate driver to drive in a first mode when the mode control signal is in a first state and to respectively control the first gate driver and the second gate driver to drive in a second mode when the mode control signal is in a second state;

wherein, in the first mode, when odd frames of images are displayed, the odd lines of gate lines are driven sequentially by the first gate driver, and when even frames of images are displayed, the even lines of gate lines are driven sequentially by the second gate driver; or, when the odd frames of images are displayed, the even lines of gate lines are driven sequentially by the second gate driver, and when the even frames of images are displayed, the odd lines of gate lines are driven sequentially by the first gate driver; and wherein in the second mode, when various frames of images are displayed, respective lines of gate lines are driven progressively;

wherein, the first gating control module further comprises a first gating clock signal terminal;

wherein the second gating control module further comprises a second gating clock signal terminal;

wherein the first gating control module comprises a first Negated AND (NAND) gate, and a second NAND gate, a first NOT gate and a second NOT gate;

wherein the first NOT gate has: an input terminal which is the first gating clock signal terminal of the first gating control module: and an output terminal connected to a first input terminal of the said NAND gate;

wherein the first NAND gate has: a second input terminal which is the mode control signal terminal of the first gating control module: and an output terminal connected to a first input terminal of the second NAND gate;

wherein the second NAND gate has: a second input terminal connected to the first trigger signal terminal: and an output terminal connected to an input terminal of the second NOT gate; and wherein the second NOT gate has an output terminal connected to the first gate driver.

2. The driving apparatus according to claim 1, wherein the first gating clock signal terminal is configured to receive a first gating clock signal, and the second gating clock signal terminal is configured to receive a second gating clock signal; and wherein the first gating clock signal and the second gating clock signal have opposite phases and a same period which is a sum of a display time of two frame cycles;

wherein when the mode control signal is in the first state:

the first gating control module transmits a first trigger signal transmitted by the first trigger signal terminal to the first gate driver to drive the odd lines of gate lines sequentially when the first gating clock signal is a valid signal; and the second gating control module transmits a second trigger signal transmitted by the second trigger signal terminal to the second gate driver to drive the even lines of gate lines sequentially when the second gating clock signal is a valid signal;

wherein when the mode control signal is in the second state:

the first gating control module transmits the first trigger signal to the first gate driver to drive the odd lines of gate lines sequentially; and the second gating control module transmits the second trigger signal to the second gate driver to drive the even lines of gate lines sequentially.

3. The driving apparatus according to claim 2, wherein the second gating control module comprises a third NAND gate, a fourth NAND gate, a third NOT gate and a fourth NOT gate; wherein the third NOT gate has;

an input terminal which is the second gating clock signal terminal of the second gating control module; and an output terminal connected to a first input terminal of the third NAND gate;

wherein the third NAND gate has:

a second input terminal which is the mode control signal terminal of the second gating control module; and an output terminal connected to a first input terminal of the fourth NAND gate;

wherein the fourth NAND gate has;

a second input terminal connected to the second trigger signal terminal; and an output terminal connected to an input terminal of the fourth NOT gate; and wherein the fourth NOT gate has an output terminal connected to the second gate driver.

4. A display apparatus, comprising the driving apparatus according to claim 3.

5. A display apparatus, comprising the driving apparatus according to claim 2.

6. A display apparatus, comprising the driving apparatus according to claim 1.

7. A gate driving method of driving a display panel as claimed in claim 1, comprising:

controlling a driving manner of the first gate driver and the second gate driver to be in a first mode when the mode control signal is in a first state, and controlling the driving manner of the first gate driver and the second gate driver to switch from the first mode to a second mode when the mode control signal changes to being in a second state from being in the first state; and controlling the driving manner of the first gate driver and the second gate driver to be in the second mode when the mode control signal is in the second state, and controlling the driving manner of the first gate driver and the second gate driver to switch from the second mode to the first mode when the mode control signal changes to being in the first state from being in the second state;

wherein in the first mode, when odd frames of images are displayed, the odd lines of gate lines are driven sequentially, and when even frames of images are displayed, the even lines of gate lines are driven sequentially; or, when the odd frames of images are displayed, the even lines of gate lines are driven sequentially, and when the even frames of images are displayed, the odd lines of gate lines are driven sequentially; and wherein in the second mode, when various frames of images are displayed, respective lines of gate lines are driven progressively.

* * * * *